US011867026B2

(12) United States Patent
Arshad et al.

(10) Patent No.: US 11,867,026 B2
(45) Date of Patent: Jan. 9, 2024

(54) COOLING DRILLING FLUID

(71) Applicant: Saudi Arabian Oil Company, Dhahran (SA)

(72) Inventors: Waheed Syed Arshad, Mississauga (CA); Misfer J. Almarri, Dhahran (SA); Bilal Tariq, Dhahran (SA); Mohammad H. Altwaijri, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/745,542

(22) Filed: May 16, 2022

(65) Prior Publication Data

US 2023/0366293 A1 Nov. 16, 2023

(51) Int. Cl.
*E21B 36/00* (2006.01)
*E21B 21/01* (2006.01)

(52) U.S. Cl.
CPC ..... *E21B 36/001* (2013.01); *E21B 21/01* (2013.01)

(58) Field of Classification Search
CPC ..... E21B 36/001; E21B 21/01; F28C 3/04
See application file for complete search history.

(56) References Cited

U.S. PATENT DOCUMENTS

2017/0276054 A1 9/2017 Shaaban et al.

FOREIGN PATENT DOCUMENTS

| | | | | |
|---|---|---|---|---|
| CN | 112523735 A | | 3/2021 | |
| CN | 113738435 A | | 12/2021 | |
| EP | 2631422 A2 | | 8/2013 | |
| GB | 1601462 A | * | 10/1981 | ..... E21B 33/00 |

OTHER PUBLICATIONS

"Accu-Freeze—Automatically Controlled Liquid Nitrogen Pipe Freezing System—Cryogenic Freeze Seal Jackets," Huntingdon Fusion Techniques, Nov. 2018, 1 page.
"Accu-Freeze—Automatically Controlled Liquid Nitrogen Pipe Freezing System," Huntingdon Fusion Techniques, Feb. 2017, 2 pages.
"Accu-Freeze—Automatically Controlled Liquid Nitrogen Pipe Freezing System," Huntingdon Fusion Techniques, Jan. 2016, 1 page.
(Continued)

*Primary Examiner* — Robert E Fuller
(74) *Attorney, Agent, or Firm* — Fish & Richardson P.C.

(57) ABSTRACT

A system for cooling drilling fluid circulating in a wellbore drilled by a wellbore drilling system includes a drilling fluid conduit positioned at a surface location separate from a wellhead of the wellbore. Drilling fluid flowed from the wellbore and an outer jacket passes through the drilling fluid conduit. An inner surface of the outer jacket at least partially defines an interior volume within which the drilling fluid conduit is at least partially disposed. The interior volume is at least partially filled with liquid nitrogen, such that the drilling fluid passing through the drilling fluid conduit is cooled by heat exchange with the liquid nitrogen across a wall of the drilling fluid conduit prior to flowing back into the wellbore via a mud pump.

20 Claims, 6 Drawing Sheets

(56) References Cited

OTHER PUBLICATIONS

"Accu-Freeze—Automatically Controlled Liquid Nitrogen Pipe Freezing System—Frequently Asked Questions" Huntingdon Fusion Techniques, Dec. 2015, 1 page.
Almarri, "Efficient History Matching of Thermally Induced Fractures Using Coupled Geomechanics and Reservoir Simulation," Energies, Jun. 2020, 13(11):3001, 43 pages.
Almarri, "Identification and characterization of Thermally Induced Fractures through integrated analytical and semi-analytical models," Journal of Petroleum Science and Engineering, Jan. 2021, 196:107930, 20 pages.
Al-Nakhli et al., "Reducing Breakdown Pressure of Tight Reservoirs Via in-Situ Pulses: Impact of Mineralogy," SPE/IATMI Asia Pacific Oil & Gas Conference and Exhibition, Oct. 2019, 12 pages.
AlTammar et al., "Application of Different Fluid Injection Methods to Reduce Breakdown Pressure," International Petroleum Technology Conference, Jan. 2020, 14 pages.
Briner et al., "Impact of Wellbore Completion Type on Fracture Initiation Pressure in Maximum Tensile Stress Criterion Model for Tight Gas Field in the Sultanate of Oman," International Petroleum Technology Conference, Dec. 2015, 12 pages.
Chavez et al., "Formation Breakdown Prediction for the Implementation of Hydraulic Fracturing on a HPHT Tight Gas Reservoir in Oman," SPE Unconventional Gas Conference and Exhibition, Jan. 201310.2118/164012-MS, 8 pages.
Farid Ibrahim et al., "Evaluation of the Breakdown Pressure to Initiate Hydraulic Fractures of Tight Sandstone and Shale Formations," SPE Trinidad and Tobago Section Energy Resources Conference, Port of Spain, Jun. 2018, 19 pages.
Fourquest.com [online], "Pipe Freezing," May 9, 2021, retrieved om Jun. 1, 2022, retrieved from URL <https://www.fourquest.com/nitrogen-services/pipe-freezing/>, 7 pages.
Gomaa et al., "New Insights into Hydraulic Fracturing of Shale Formations," International Petroleum Technology Conference, Jan. 2014, 17 pages.
Oparin et al., "Impact of Local Stress Heterogeneity on Fracture Initiation in Unconventional Reservoirs: A Case Study from Saudi Arabia." SPE Annual Technical Conference and Exhibition, Sep. 2016, 18 pages.
Sakhaee-Pour et al.,, "Predicting Breakdown Pressure and Breakdown Cycle in Cyclic Fracturing," SPE Production & Operations, Jun. 2018, 33(04):761-769, 9 pages.
Trichel et al., "Understanding and Managing Bottom Hole Circulating Temperature Behavior in Horizontal HT Wells—A Case Study Based on Haynesville Horizontal Wells," Presented at the SPE/IADC Drilling Conferenced and Exhibition, Amsterdam, The Netherlands, Mar. 1-3, 2011; SPE/IADC 140332, SPE International, 20 pages.
Vilarrasa et al., "Impacts of thermallly induced stresses on facture stability during geological storage of CO2," Energy Procedia, Jan. 2016, 86:411-419, 9 pages.
Wikipedia.org [online], "Supercooling," May 31, 2022, retrieved on Jun. 1, 2022, retrieved from URL <https://en.wikipedia.org/wiki/Supercooling>, 9 pages.

* cited by examiner

COOLING DRILLING FLUID

TECHNICAL FIELD

This disclosure relates to the production of oil, gas, or other resources from subterranean zones to the surface.

BACKGROUND

Hydrocarbons trapped in subsurface reservoirs can be raised to the surface of the Earth (that is, produced) through wellbores formed from the surface to the subsurface reservoirs. Wellbore drilling systems are used to drill wellbores through a subterranean zone (for example, a formation, a portion of a formation or multiple formations) to the subsurface reservoir. At a high level, the wellbore drilling system includes a drill bit connected to an end of a drill string. The drill string is rotated and weight is applied on the drill bit to drill through the subterranean zone. Wellbore drilling fluid (also known as drilling mud) is flowed in a downhole direction through the drill string. The drilling fluid exits the drill bit through ports defined in the drill bit and can be circulated in an uphole direction through an annulus defined by an outer surface of the drill string and an inner wall of the wellbore to the surface and then recirculated downhole after filtering and other treatment processes, in a closed (or partially closed) loop.

SUMMARY

Certain aspects of the subject matter herein can be implemented as a system for cooling drilling fluid circulating in a wellbore drilled by wellbore drilling system. The system includes a drilling fluid conduit positioned at a surface location separate from a wellhead of the wellbore. Drilling fluid flowed from the wellbore and an outer jacket passes through the drilling fluid conduit. An inner surface of the outer jacket at least partially defines an interior volume within which the drilling fluid conduit is at least partially disposed. The interior volume is at least partially filled with liquid nitrogen, such that the drilling fluid passing through the drilling fluid conduit is cooled by heat exchange with the liquid nitrogen across a wall of the drilling fluid conduit prior to flowing back into the wellbore via a mud pump.

An aspect combinable with any of the other aspects can include the following features. The system can also include a coolant injection system configured to selectively inject liquid nitrogen into the coolant volume.

An aspect combinable with any of the other aspects can include the following features. The drilling fluid flowed from the wellbore can pass through a shale shaker prior to passing through the drilling fluid conduit.

An aspect combinable with any of the other aspects can include the following features. The drilling fluid can flow from the drilling fluid conduit to a mud pump, the mud pump configured to pump the drilling fluid back into the wellbore.

An aspect combinable with any of the other aspects can include the following features. At least a portion of the drilling fluid can flows from the drilling fluid conduit to an insulated circulating tank and thence from the insulated circulating tank back to the drilling fluid conduit, prior to flowing from the drilling fluid conduit to the mud pump.

An aspect combinable with any of the other aspects can include the following features. The drilling fluid conduit and the outer jacket are can be coaxial tubulars.

An aspect combinable with any of the other aspects can include the following features. The interior volume can be at least partially defined by an outer surface of the drilling fluid conduit.

An aspect combinable with any of the other aspects can include the following features. The drilling fluid conduit can be concentric with the outer jacket.

An aspect combinable with any of the other aspects can include the following features. The drilling fluid conduit can be a first drilling fluid conduit of a plurality of drilling fluid conduits disposed within, the outer jacket.

An aspect combinable with any of the other aspects can include the following features. The liquid nitrogen can be in direct contact with an outer surface of the drilling fluid conduit.

An aspect combinable with any of the other aspects can include the following features. The liquid nitrogen may not be in direct contact with an outer surface of the drilling fluid conduit.

An aspect combinable with any of the other aspects can include the following features. The system can further include an intermediate tubular coaxial with and disposed within the outer jacket and within which the drilling fluid conduit is disposed. An annular volume can be defined by an inner surface of the intermediate tubular and an outer surface of the drilling fluid conduit and can be at least partially filled with water. Cooling the drilling fluid flowing through the drilling fluid conduit by heat exchange with the liquid nitrogen across the wall of the drilling fluid conduit can include cooling the water filling the annular volume at least partially by heat exchange with the liquid nitrogen and cooling the drilling fluid at least partially by heat exchange with the water filling the annular volume.

An aspect combinable with any of the other aspects can include the following features. The system can also include a plurality of fins extending radially from an outer surface of the drilling fluid conduit Certain aspects of the subject matter herein can be implemented as an apparatus for cooling a drilling fluid circulating in a wellbore drilling system configured to drill a wellbore. The apparatus includes a main body, a drilling fluid conduit disposed within the main body, and an outer jacket. An inner surface of the outer jacket at least partially defines an interior volume within which the drilling fluid conduit is at least partially disposed. The interior volume is configured to be at least partially filled with liquid nitrogen. The apparatus is configured such that, when the apparatus is positioned at a surface location separate from a wellhead of the wellbore and configured so as to receive a volume of drilling fluid flowed from the wellbore, the volume of drilling fluid can pass through the drilling fluid conduit and the drilling fluid is cooled by heat exchange with the liquid nitrogen across a wall of the drilling fluid conduit prior to flowing back into the wellbore via a mud pump.

An aspect combinable with any of the other aspects can include the following features. The wellbore drilling system can be a wellbore drilling system for drilling a wellbore at a first wellsite, and the apparatus can be an assembly configured to be transported as a unit from the wellbore drilling system at the first wellsite to a wellbore drilling system at a second wellsite.

An aspect combinable with any of the other aspects can include the following features. The apparatus can be configured such that liquid nitrogen from a coolant injection system can fill the coolant volume. The coolant injection system can be a component of the apparatus.

An aspect combinable with any of the other aspects can include the following features. The liquid nitrogen can be in direct contact with an outer surface of the drilling fluid conduit.

An aspect combinable with any of the other aspects can include the following features. The apparatus can also include an intermediate tubular coaxial with and disposed within the outer jacket and within which the drilling fluid conduit is disposed. An annular volume can be defined by an inner surface of the intermediate tubular and an outer surface of the drilling fluid conduit and can be at least partially filled with water. Cooling the drilling fluid flowing through the drilling fluid conduit by heat exchange with the liquid nitrogen across the wall of the drilling fluid conduit can include cooling the water filling the annular volume at least partially by heat exchange with the liquid nitrogen and cooling the drilling fluid at least partially by heat exchange with the water filling the annular volume.

Certain aspects of the subject matter herein can be implemented as a method of cooling a drilling fluid circulating in a wellbore drilled by a wellbore drilling system. The method includes filling, with liquid nitrogen, an interior volume of a cryogenic heat exchange system positioned at a surface location separate from a wellhead of the wellbore. The interior volume is at least partially defined by an inner surface of an outer jacket of the cryogenic heat exchange system. A drilling fluid flowed from the wellbore is flowed through a drilling fluid conduit of the cryogenic heat exchange system at least partially disposed in the interior volume. The drilling fluid is cooled by heat exchange with the liquid nitrogen across a wall of the drilling fluid conduit and is flowed via a mud pump back into the wellbore.

An aspect combinable with any of the other aspects can include the following features. The method can also include flowing the drilling fluid from the drilling fluid conduit to an insulated circulating tank, flowing at least a portion of the drilling fluid from the insulating circulating tank back to the drilling fluid conduit, cooling, by heat exchange with the liquid nitrogen across the wall of the drilling fluid conduit, the portion, and flowing, by the mud pump, the portion from the drilling fluid conduit to the wellbore. The flowing, via the mud pump, the drilling fluid back into the wellbore can include flowing the portion into the wellbore.

The details of one or more embodiments are set forth in the accompanying drawings and the description below. Other features, objects, and advantages will be apparent from the description, drawings, and claims.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

High temperatures within a wellbore can interfere with the functioning of downhole magnetometers, downhole electronics, downhole sensors, and other downhole components of a drillstring or other assembly. For example, long lateral wellbores in high temperature subsurface environments (with, for example, bottomhole temperatures greater than three-hundred degrees Fahrenheit) can present particular drilling challenges. Such circumstances can cause higher frequency of temperature-related measurement-while-drilling (MWD) and logging-while-drilling (LWD) failures and also strongly affect the performance of drilling fluids, cements, well casing and tubing, elastomers and seals in packers. It has also been established that, in long horizontal wells under certain operating well conditions, the bottom-hole circulation temperature can rise above the static bottom-hole temperature.

In accordance with embodiments of the present disclosure, a cryogenic fluid system is used to cool drilling fluid or other wellbore fluid after it comes out from the well through the flowline and before being recirculated downhole. In accordance with some embodiments, liquid nitrogen at extremely low cryogenic temperatures is used as a heat exchanger medium to cool the wellbore fluid. The cryogenic heat exchange system of the present disclosure can be a simple, on-site, mobile unit that can be easily plumbed into the mud pits and/or other rig systems to provide in-line cooling of the wellbore fluid as it comes out of the hole. In some embodiments, drilling fluid cooled by the cooling system can be recirculated through a loop system back to cooling system for further cooling prior to being pumped downhole. The cooled wellbore fluid can reach a formation at a much lower temperature than otherwise possible with prior cooling systems, thus reducing or eliminating the negative effects of high downhole temperatures on drilling and other equipment and processes. The system, apparatus, or method of the present disclosure can be cost effective, easy to install, and relatively low risk system to lower the temperature of wellbore fluid, thus providing substantial HS&E benefits on surface, reducing equipment failures, providing better control of mud properties, and enabling drilling in higher-temperature regions. The system, apparatus, or method of the present disclosure can help extend the operating envelope of downhole tools, thus enabling the exploration of and production from hot reservoirs that are beyond reach with prior systems, apparatus, and methods.

Figure 1:
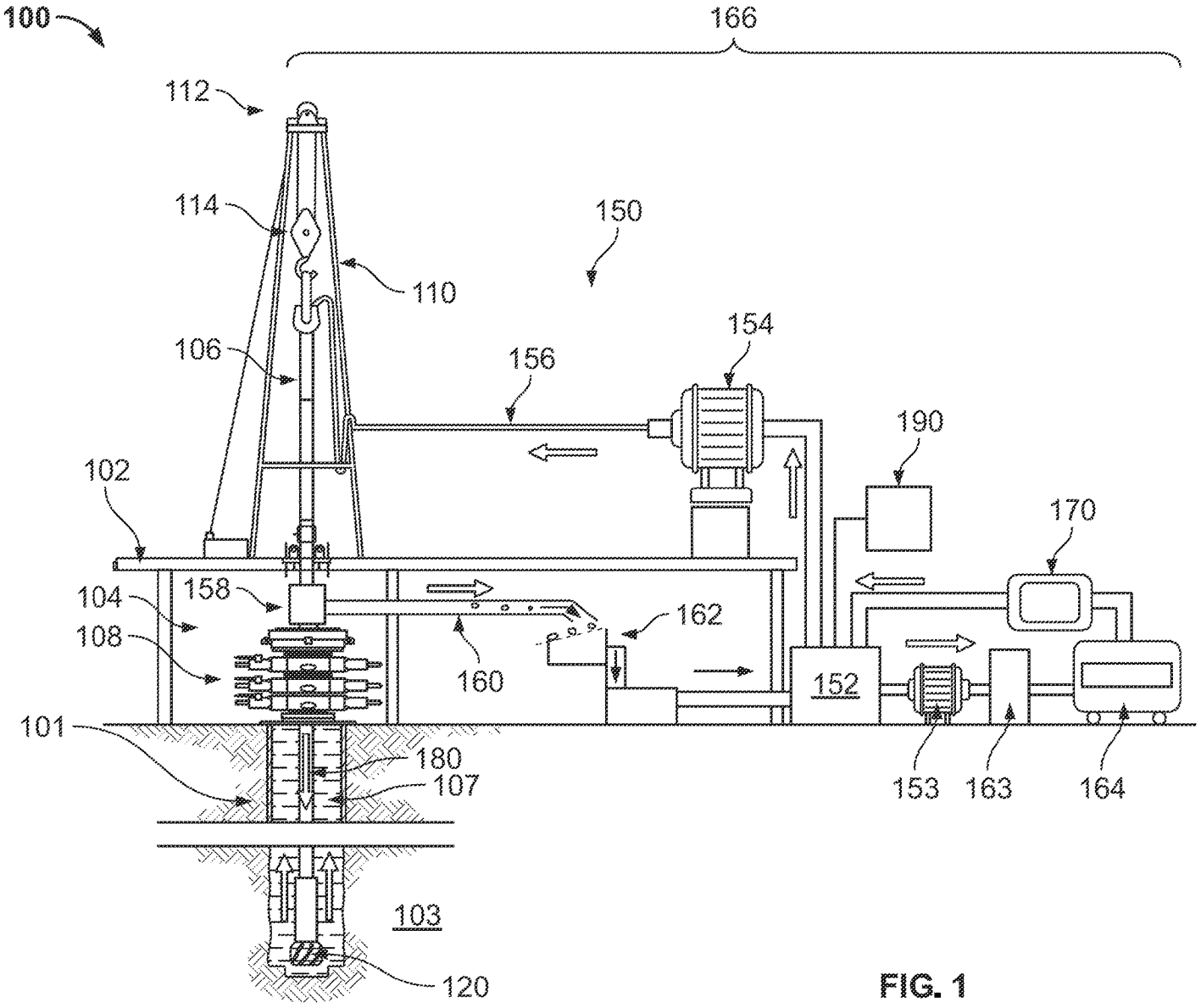
FIG. 1 is a schematic illustration of a well system with a cryogenic heat exchange system in accordance with an embodiment of the present disclosure.

FIG. 1 is a schematic diagram of a wellbore drilling system 100 configured to drill a wellbore 101, in accordance with an embodiment of the present disclosure. While the illustrated embodiment is a drilling system circulating a drilling fluid that is cooled by the cooling system of the present disclosure, it will be understood that the apparatus, system, and method of the present disclosure is not limited to drilling systems or to drilling fluid but can be applied to other well systems (such as completed production wells) and to cooling other fluids other than drilling fluid that are flowed into or circulated through wells, such as stimulation fluids or lost circulation pills. Wellbore 101 can extend from the surface through the Earth to one or more subterranean zones 103 of interest. The wellbore drilling system 100 includes a drill floor 102 positioned above the surface, a wellhead 104, and a drill string assembly 106 supported by the rig structure. Wellhead 104 supports casing or other wellbore components or equipment into the wellbore and includes various spools, valves, and assorted adapters that provide pressure control for the well. Atop wellhead assembly 104 is a blowout preventer 108 which acts to prevent wellbore blowouts caused by formation fluid entering the wellbore, displacing drilling fluid, and flowing to the surface at a pressure greater than atmospheric pressure. The blowout preventer 108 can close around (and in some instances, through) the drill string assembly 106 and seal off the space between the drill string and the wellbore wall.

The derrick 110 is a support framework mounted on the drill floor 102 and positioned over the wellbore to support the components of the drill string assembly 106 during drilling operations. A crown block 112 is positioned at top of the derrick 110 and connects to a travelling block 114 with a drilling line including a set of wire ropes or cables. The crown block 112 and the travelling block 114 support the drill string assembly 106 via a swivel, kelly, and/or top drive system.

In the wellbore drilling system 100 of FIG. 1, the drill string assembly 106 is made up of drill pipes with a bottomhole assembly 120 at its downhole end. Bottomhole assembly 120 can include a drill bit that rotates and penetrates through rock formations below the surface under the combined effect of axial load and rotation of the drill string assembly 106. Bottomhole assembly 120 can further include collars, directional drilling (MWD/LWD) instrumentation, and various electrical, electronic, or mechanical components for operating and/or controlling the drill bit.

Wellbore drilling system 100 further includes a drilling fluid 180 (sometimes referred to as drilling mud) which can serve to control formation pressures, remove cuttings from the wellbore, seal permeable formations encountered while drilling, cool and lubricating the drill bit and other components of bottomhole assembly 120, transmit hydraulic energy to downhole tools and the drill bit, and maintain wellbore stability and well control. During a drilling operation of the well, circulation system 150 circulates drilling fluid 180 to the drill string assembly 106, receives and filters used drilling fluid from the wellbore, and returns clean drilling fluid to the drill string assembly 106. Specifically, circulation system 150 includes a mud pump 154 that fluidly connects to and provides drilling fluid from mud pit 152 to drill string assembly 106 via the kelly hose 156. The drilling fluid flows through the drill string assembly 106, flows out the drill bit in bottomhole assembly 120 and back up the annulus 107. Annulus 107 is the space between the drill string assembly 106 and wellbore 101 or formation or casing disposed within wellbore 101. The drilling fluid 180 returns to the surface in the annulus 107 with rock cuttings and flows out bell nipple 158 to the flow-out line 160. From flow-out line 160, the fluid passes through a shale shaker 162 and its associated components. Shale shaker 162 can include a mesh-like surface to separate the rock cuttings and other debris from the drilling fluid 180. Drilling fluid 180 flows from shale shaker 162 to mud pit 152. At least a portion of drill fluid 180 can then be pumped from mud pit 152 back to drill string assembly 106 by mud pump 154, thus completing the circulation loop.

In the illustrated embodiment, circulation system 150 further includes a cryogenic heat exchange (CHE) system 164. As described in greater detail below, CHE system 164 can cool drilling fluid 180 by heat exchange with liquid nitrogen. Mud pit 152 can include one or more compartments or valves to selectively divert at least a portion of drilling fluid 180 to an intermediate circulation pump 153 which can, in turn, pump that portion of the drilling fluid 180 to CHE system 164. Drilling fluid 180 cooled by cryogenic heat exchange system 164 can flow back into mud pit 152. In some embodiments, valves within or connected to mud pit 152 can return all or a portion of the cooled fluid from mud pit 152 to the drill string 106 via mud pump 154 and kelly hose 156 as described above.

In some embodiments, valves within or connected to mud pit 152 can divert all or a portion of the cooled drilling fluid back to CHE system 164 for further cooling prior to being returned to drill string 106, and such recirculation and re-cooling can be repeated until the desired level of cooling is achieved. In such embodiments, circulation system 150 can further include an insulated intermediate holding tank 170 for collecting such recirculating fluid and, when the cooled fluid has reached a suitably low temperature, the fluid can be redirected back to drill string 106 via mud pump 154. Such collection and recirculating through intermediate holding tank 170 can in some embodiments enable a reduction in drilling fluid temperature to super-cooling temperature ranges.

In some embodiments, a control module 190 can be connected to one or more of the valves, temperature sensors, and/or other control devices or sensors within or connected to mud pump 154, and/or to CHE system 164. Control module 190 can in some embodiments receive and display measurements such as temperature, flow rate, and fluid volume, and can receive inputs to divert, flow, collect, or recirculate fluids through CHE system 164, intermediate holding tank 170, and other components of circulation system 150. In some embodiments, circulation system 150 does not include an insulated intermediate holding tank.

Figure 2:
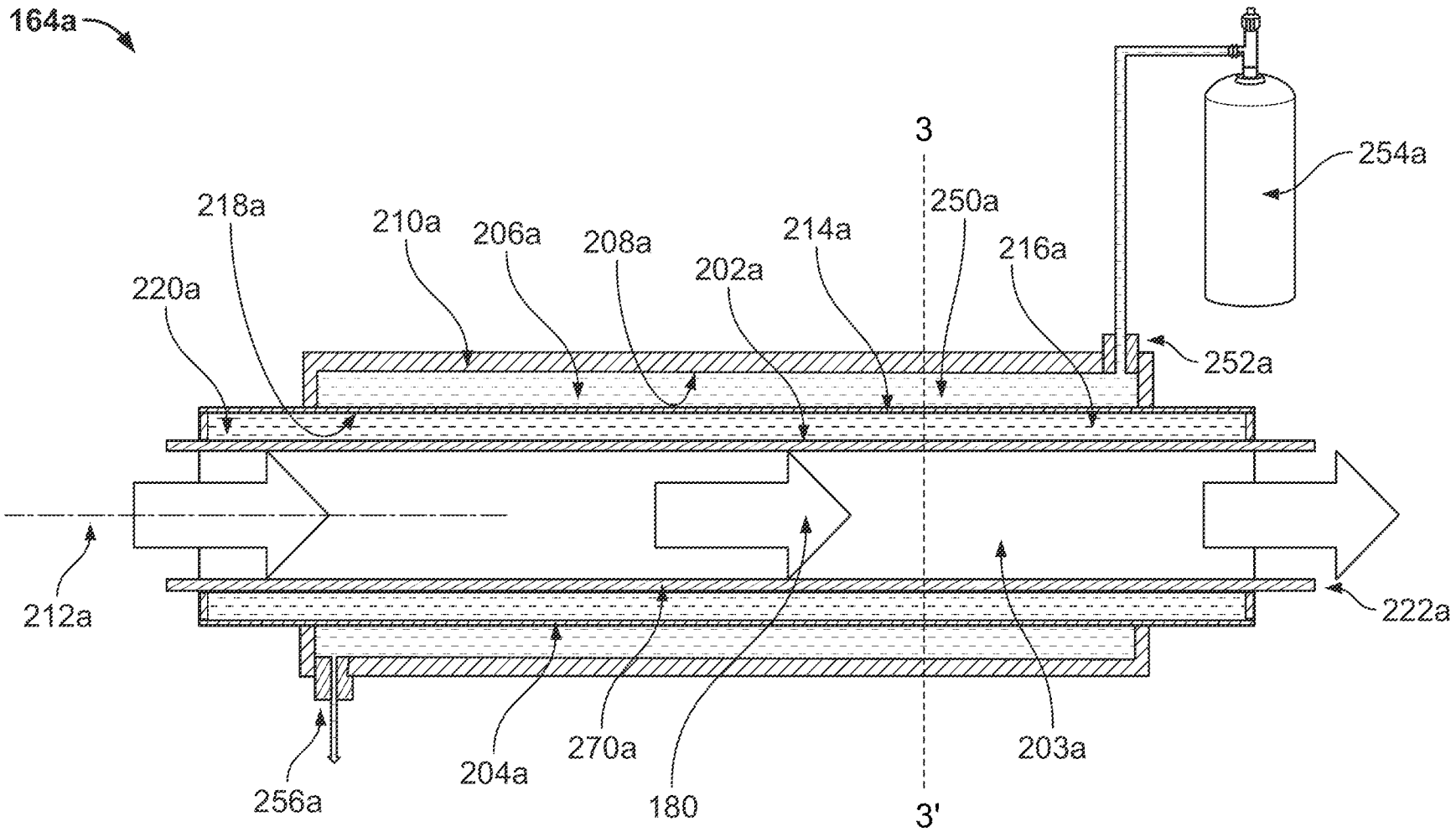
FIG. 2 is a schematic illustrations of a cryogenic heat exchange system in accordance with an embodiment of the present disclosure.
Figure 3:
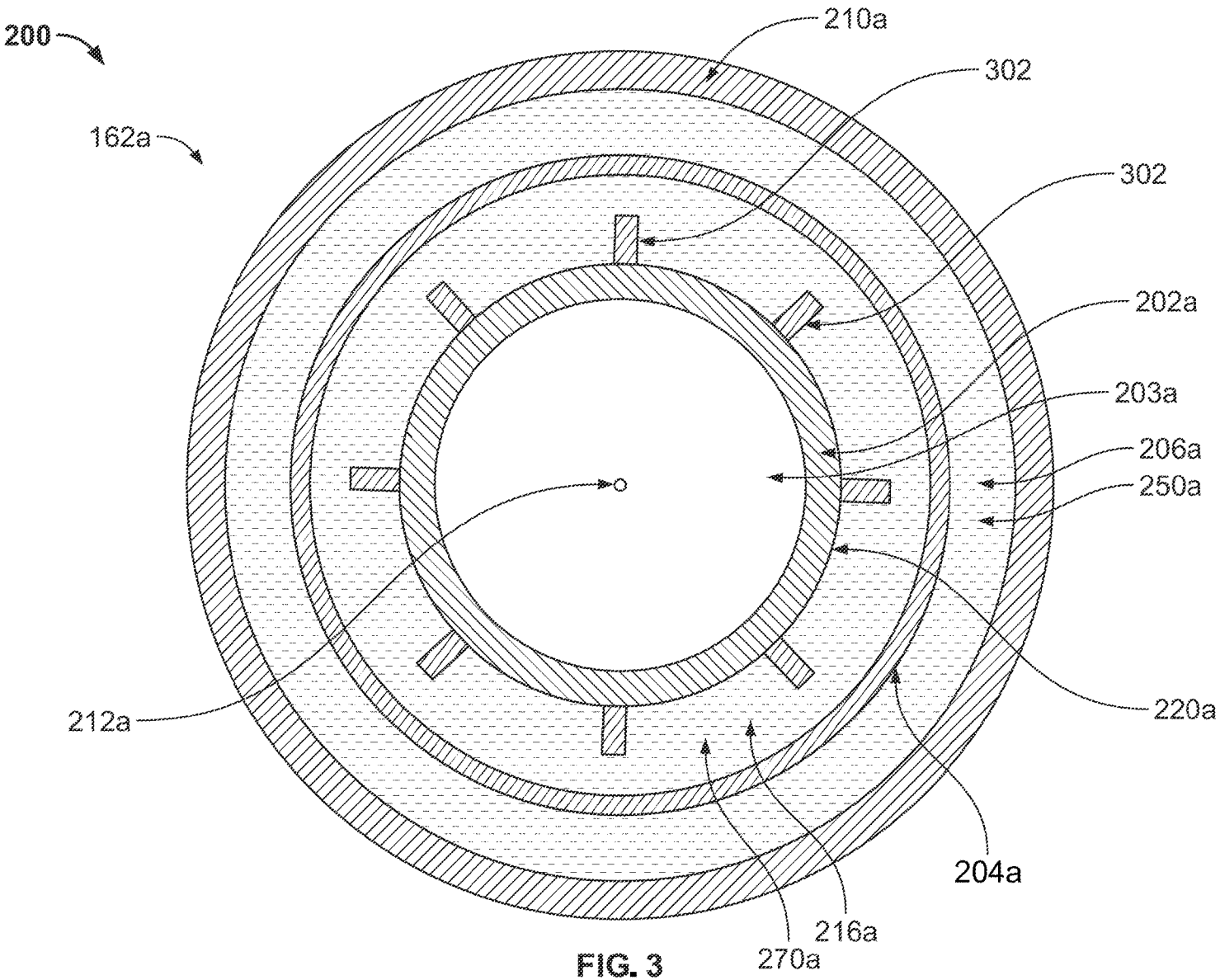
FIG. 3 is a cross-sectional schematic illustrations of a cryogenic heat exchange system in accordance with an alternative embodiment of the present disclosure.
Figure 4:
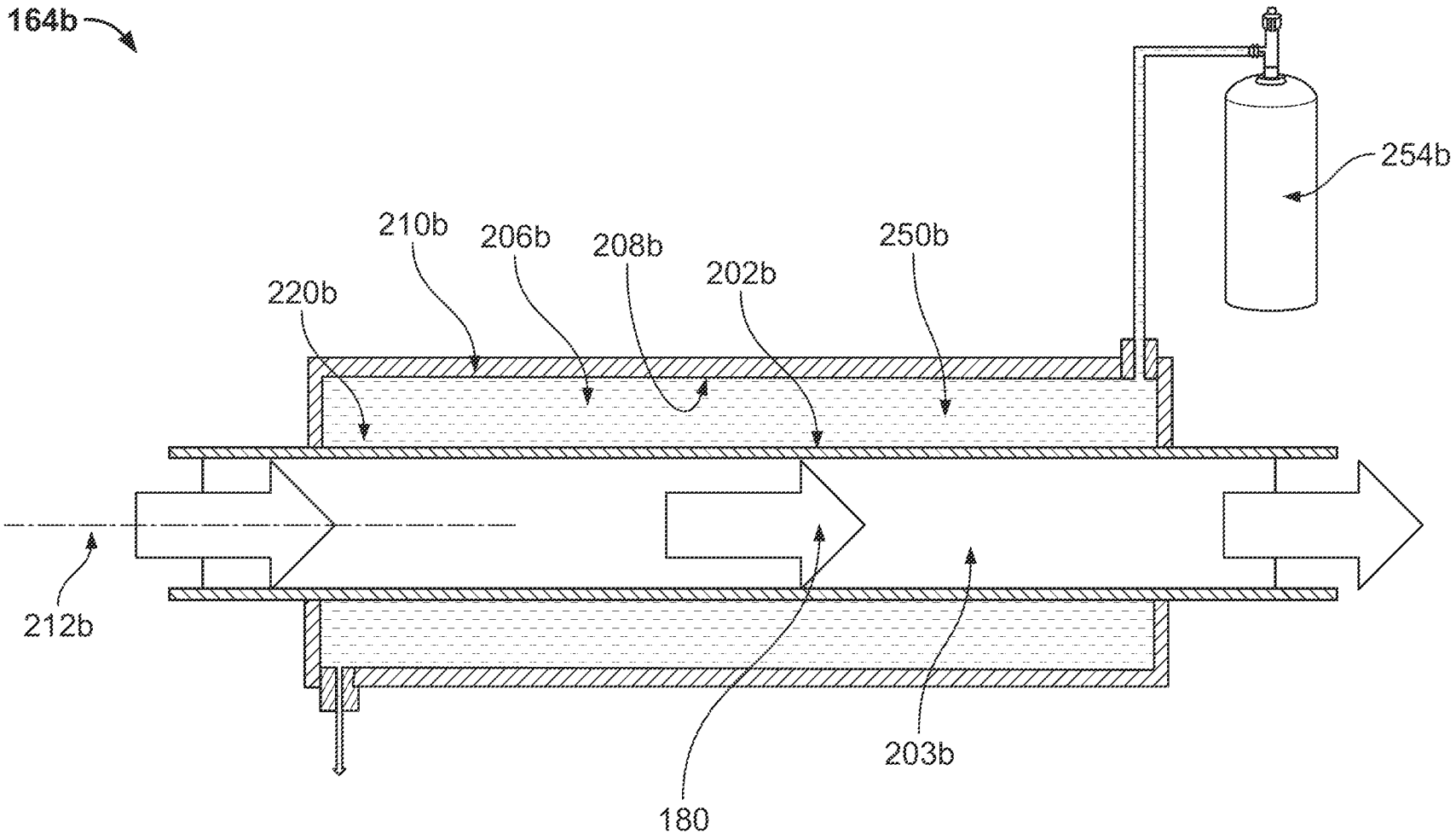
FIG. 4 is a schematic illustrations of a cryogenic heat exchange system in accordance with an alternative embodiment of the present disclosure.
Figure 5:
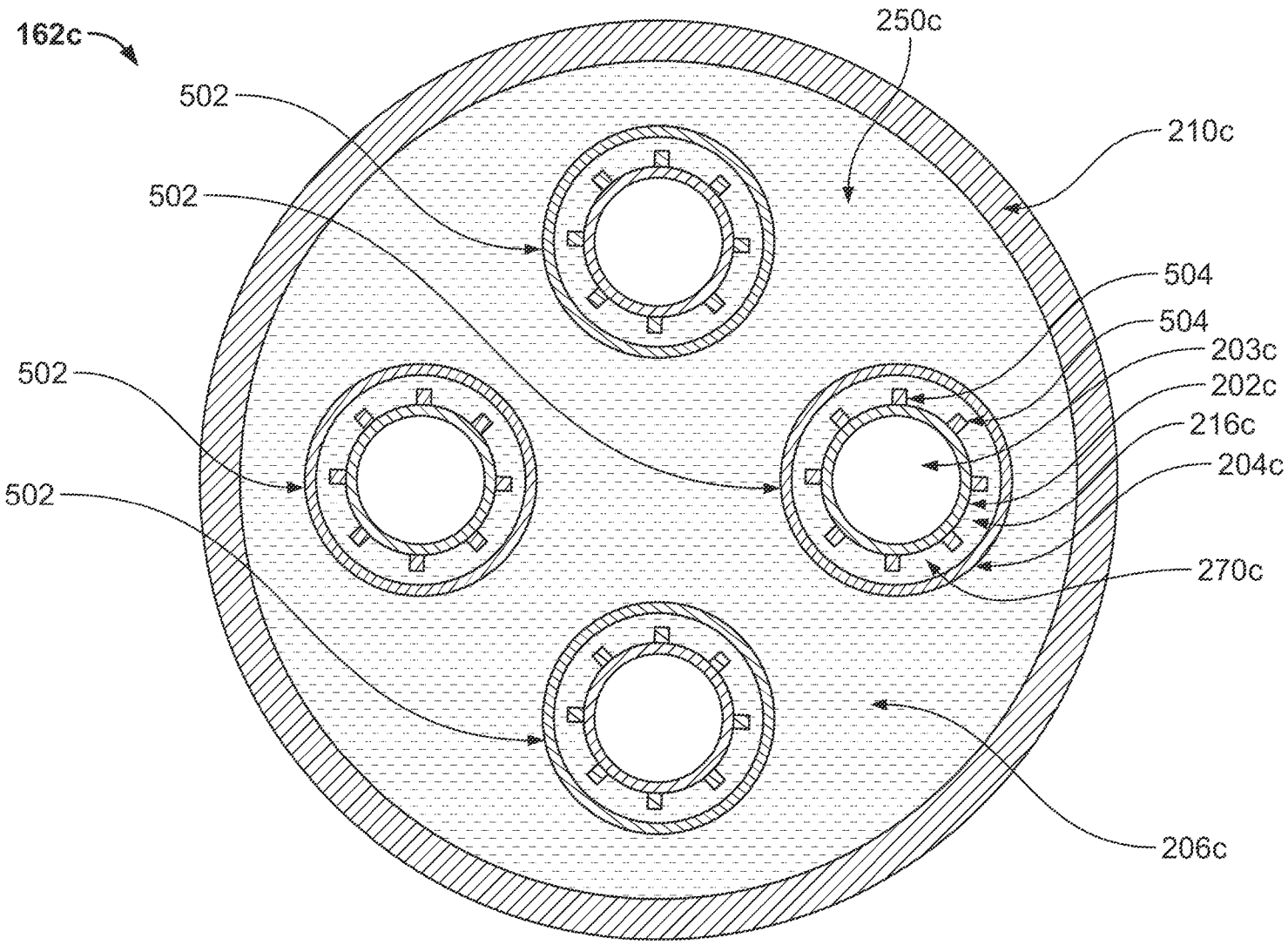
FIG. 5 is a schematic illustrations of a cryogenic heat exchange system in accordance with an alternative embodiment of the present disclosure.

In various embodiments of the present disclosure, CHE system 164 can be or can include, for example, CHE system 164*a* as described in reference to FIGS. 2 and 3, CHE system 164*b* as described in reference to FIG. 4, or CHE system 164*c* as described in reference to FIG. 5 with some or all of the features described therein, alone or in combination.

In the illustrated embodiment, CHE system 164 is not (and is not part of) a pressure-control component of wellhead 104 or blow-out preventer 108. Instead, in the illustrated embodiment, CHE system 164 is located at a surface location separate from (for example, a surface distance 166 from) wellhead 104 on the low-pressure side of operations, and drilling fluid 180 flowing from wellbore 101 flows through cryogenic heat exchange system 164 after flowing through shale shaker 162 and prior to returning to mud pump 154. In some embodiments, surface distance 166 is about 50 feet; in other embodiments, surface distance 166 can be a greater or lesser distance. In the illustrated embodiment, a filter 163 is disposed between intermediate circulation pump 153 to filter out particulate matter from drilling fluid 180 prior to flowing into CHE 164.

In some embodiments, CHE system 164 is a transportable unit. For example, if wellbore drilling system 100 is for drilling a wellbore at, for example, a first wellsite, CHE system 164 can be configured to be disconnected and transported as a unit from wellbore drilling system 100 to another, separate wellbore drilling system drilling a separate wellbore at, for example a second wellsite.

The example well system 100 can take a variety of forms and can include fewer components and/or a number of different or additional components. For example, circulation system 150 can include various settling pits, valves, and other associated components in addition to those described above. Furthermore, while well system 100 is shown as a land-based drilling rig, the apparatus, systems and methods described herein can be applied to offshore drilling rigs and to other well systems other than drilling systems (for example production wells or workover rigs) and to wellbore fluids other than drilling fluids.

FIG. 2 is a schematic illustration of a CHE system in accordance with an embodiment of the present disclosure, for cooling a fluid (for example, drilling fluid 180 in the drilling system 100 of FIG. 1). Referring to FIG. 2, CHE system 164*a* includes a drilling fluid conduit 202*a* (which includes a central bore 203*a* through which drilling fluid 180 flows) and an intermediate tubular 204*a*, both of which are disposed within an interior volume 206*a* defined (at least partially) by an inner surface 208*a* of an outer jacket 210*a*. It will be understood that outer jacket 210*a* may not be the outermost surface of the CHE system, and that a cover or other component (not shown) may form the outer surface of the CHE system and that outer jacket 210*a* may be disposed within such a cover or other component. In the illustrated embodiment, drilling fluid conduit 202*a*, intermediate tubular 204*a*, and outer jacket 210*a* are substantially cylindrical and are coaxial and concentric. That is, drilling fluid conduit 202*a* is disposed within intermediate tubular 204*a*, which is in turn disposed within outer jacket 210*a*, and each share the same central axis 212*a*. In other embodiments, drilling fluid conduit 202*a*, intermediate tubular 204*a*, and outer jacket 210*a* can be other than substantially cylindrical and can be other than coaxial or concentric. In the embodiment shown in FIG. 2, interior volume 206*a* is further defined by an outer surface 214*a* of intermediate tubular 204*a*, and an annular volume 216*a* is defined at least partially by an inner surface 218*a* of intermediate tubular 204*a* and an outer surface 220*a* of drilling fluid conduit 202*a*. In the illustrated embodiment, interior volume 206*a* and annular volume 216*a* are closed volumes that are sealed so as to not permit any flow of fluid into or out of them, except for fluid flow permitted through one or more inlet ports or outlet ports which may be disposed on or though the walls of outer jacket 210*a* and intermediate tubular 204*a*, respectively. In other embodiments, the outer jacket and/or the intermediate tubular may be otherwise configured with respect to fluid flow within, out of, or into them. In some embodiments, other cryogenic cooling components (such as the Accu-Freeze freezing system from Huntingdon Fusion Technologies) can be include instead of or in addition to the components herein described.

In the illustrated embodiment, liquid nitrogen 250*a* can be injected into interior volume 206*a* through an inlet port 252*a* by an injection system 254*a*, such that the liquid nitrogen 250*a* fills or substantially fills interior volume 206*a*. Drilling fluid 180 flowed from a wellbore and passing through drilling fluid conduit 202*a* can be cooled by heat exchange with liquid nitrogen 250*a* across a wall 222*a* of drilling fluid conduit 202*a*, prior to the drilling fluid 180 being pumped back into the wellbore or recirculated for additional cooling as described above with respect to FIG. 1. Injection system 254*a* can, in some embodiments, include a liquid nitrogen storage tank, a cryogenic pumper, plumbing for pumping liquid nitrogen, temperature measurement devices (e.g. thermocouples), recording systems, automatic temperature controllers, and other suitable components, depending on the plumbing lines used on the rig and applicable heat transfer requirements on case-by-case basis. Excess liquid nitrogen can exit interior volume 206*a* via outlet port 256*a*. In some embodiments, injection system 254*a* is a component of CHE 164*a* and can be transported together as a unit. In other embodiments, injection system 254*a* is a component of a well system separate from CHE system 254*a*.

In the illustrated embodiment, annular volume 216*a* can be at least partially filled with water 270*a*. The cooling of drilling fluid 180 by heat exchange with the liquid nitrogen 250*a* across the wall 222*a* can include cooling the drilling fluid 180 by heat exchange with the water 270*a*, with the water 270*a* in turn being cooled by heat exchange with the liquid nitrogen 250*a*. In some embodiments, water 270*a* can sufficiently cooled by liquid nitrogen such that water 270*a* is in a solid (ice) state as the drilling fluid 180 flows through drilling fluid conduit 202*a*. In some embodiments, the CHE system of the present disclosure can provide water in the annular volume 216*a* at temperatures below 32° F. on surface. The heat exchanger will be available to deliver water in the temperature range of −4° F. to −30° F. which should be a significant improvement over the use of water chillers. Water 270*a* can act as a buffer between the liquid nitrogen and the drilling fluid and can, in some embodiments, afford better control of the heat exchange process than if no water buffer were present.

FIG. 3 is a schematic illustration of CHE system 164*a* of FIG. 2, shown in a cross-sectional view along 3-3' as shown in FIG. 2, in accordance with an embodiment of the present disclosure, showing the coaxial and concentric relationship of drilling fluid conduit 202*a* (having central bore 203*a*) which is disposed within intermediate tubular 204*a* (enclosing volume 216*a* filled with water 270*a*) which is in turn disposed within outer jacket 210*a* (enclosing volume 206*a* filled with liquid nitrogen 250*a*), with each sharing a central axis 212*a*, as described above in reference to FIG. 2. In the illustrated embodiment, eight fins 302 are disposed circumferentially about, and extend from, outer surface 220*a* of drilling fluid conduit 202*a*. Fins 302*a* can increase the rate of heat exchange between the drilling fluid and the liquid nitrogen and/or water layers. Other embodiments may include no such fins or may include a greater or lesser number of fins.

FIG. 4 is a schematic illustration of a CHE system in accordance with an alternative embodiment of the present disclosure. Drilling fluid conduit 202*b* is disposed within an outer jacket 210*b*, similar to drilling fluid conduit 202*a* and outer jacket 210*a* of FIG. 2. Likewise, CHE system 164*b* includes injection system 254*b* for injecting liquid nitrogen 250*b* (corresponding to injection system 254*a* and liquid nitrogen 250*a* of FIG. 1). Interior volume 206*b* of CHE system 164*b* is defined (at least partially) by inner surface 208*b* of outer jacket 210*b* and outer surface 220*a* of drilling fluid conduit 202*b*. In contrast to CHE system 164*a* of FIG. 2, liquid nitrogen 250*b* (injected by into volume 206*b* by injection system 245*b*) is in direct contact with the outer surface 220*b* of drilling fluid conduit 202*b*, as there is no intermediate tubular defining a water-filled annular volume. Such direct contact can increase the rate of heat exchange between the liquid nitrogen and drilling fluid 180. In some embodiments, having the liquid nitrogen in direct contact with outer surface 220 of the drilling fluid conduit can provide faster cooling of the drilling fluid than the configuration shown in FIGS. 2 and 3, in situations where a water buffer is not necessary or advantageous. It will be understood that the phrase "cooled by heat exchange with the liquid nitrogen across a wall of the drilling fluid conduit" can include (but is not necessarily limited to) either a configuration such as in FIG. 2 where the liquid nitrogen is not in direct contact with the outer surface of the drilling fluid conduit and the drilling fluid is cooled by heat exchange with an intermediate volume of water (with the water in turn being cooled by heat exchange with the liquid nitrogen), or a configuration such as FIG. 4, where the liquid nitrogen is in direct contact with the outer surface of the drilling fluid conduit.

FIG. 5 is a schematic illustration of a CHE system in accordance with an alternative embodiment of the present disclosure. Specifically, FIG. 5 is a cross-sectional view of a CHE system 164*c* which can include the same components and structure as system 164*a* of FIG. 2 except that, in contrast to CHE system 164*a*, CHE system 164*c* includes a plurality of flow conduit assemblies 502 within an outer jacket 210*c*. Each flow conduit assembly 502 includes a drilling fluid conduit 202*c* including a central bore 203*c* through which drilling fluid (such as drilling fluid 180 of FIG. 1) can flow. In the illustrated embodiment, each flow conduit assembly further includes an annular volume 216*c* defined (at least partially) by an interior surface of the intermediate tubular 204*c* and filled with water 270*c* (similar to the arrangement for annular volume 216*a* and intermediate tubular 204*a* as described above with respect to FIG. 2). Each flow conduit assembly is disposed within interior volume 206*c* filled with liquid nitrogen 250*c* and defined (at least partially) by the inner surface of outer jacket 210*c*. Having such a plurality of drilling fluid conduits (as opposed to merely a singular drilling fluid conduit) can, in some embodiments, increase the rate of heat exchange between the liquid nitrogen and the drilling fluid. In other embodiments, some or all of the plurality of fluid conduit assemblies do not include the intermediate tubular or water-filled annular volume and instead have direct contact between the liquid nitrogen and the outer surface of the drilling fluid conduits. In the illustrated embodiment, a plurality of fins 504 are disposed circumferentially about each of the drilling fluid conduit 202*c*, similar to fins 302 as described in reference to FIG. 3. Other embodiments may include no such fins or may include a greater or lesser number of fins.

Figure 6:
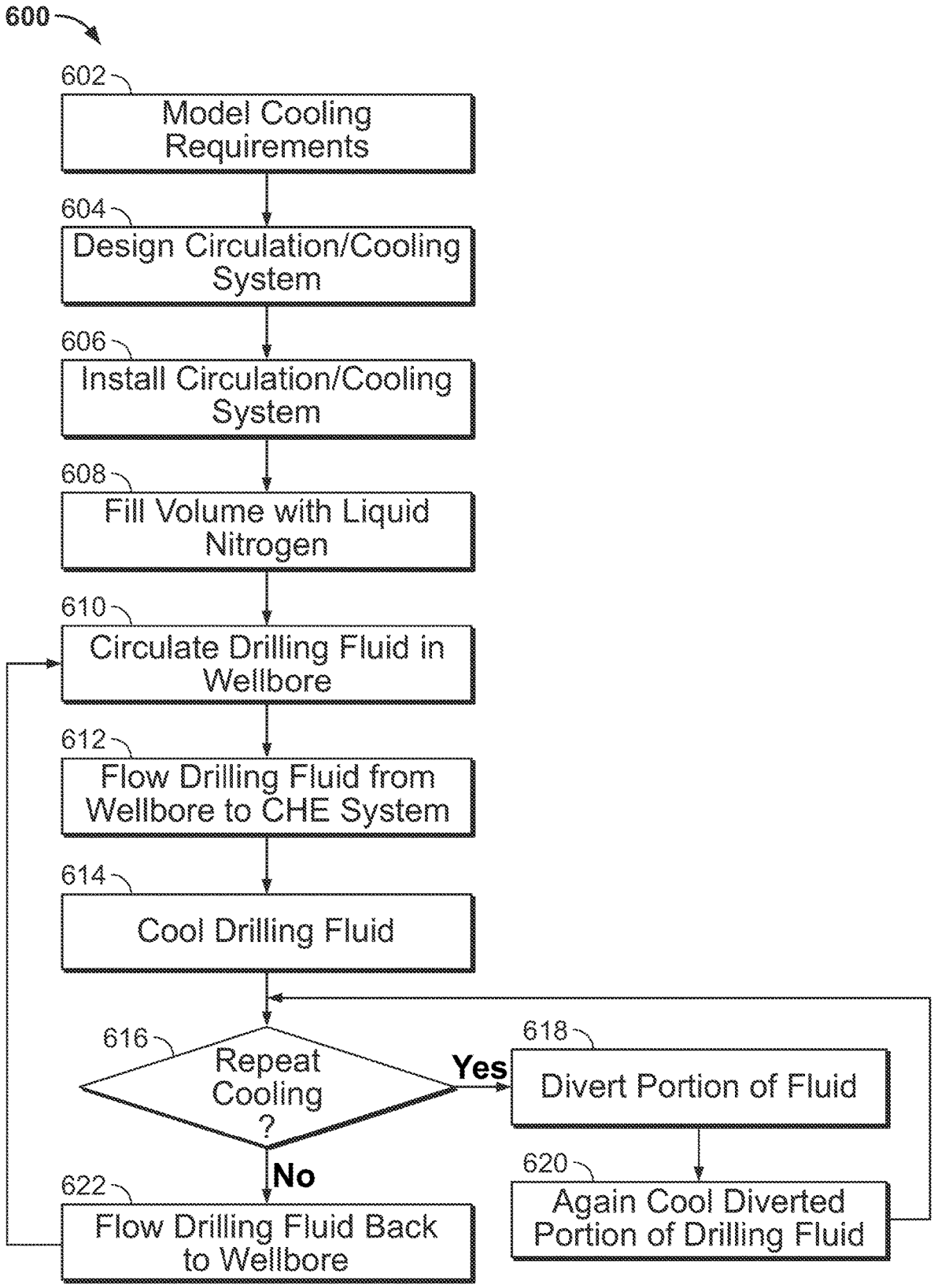
FIG. 6 is a process flow diagram of a method of cooling a drilling fluid circulating in a wellbore drilled by a wellbore drilling system in accordance with an embodiment of the present disclosure.

FIG. 6 is a process flow diagram of a method 600 of cooling a wellbore fluid in accordance with an embodiment of the present disclosure. Method 600 is described with reference to drilling fluid circulating in a wellbore drilled by a wellbore drilling system; however, it will be understood some or all of the steps of the method can be applicable to other well system types and other well fluids. Method 600 begins at step 602 wherein cool-down temperature requirements for wellbore fluid (such as drilling fluid) in a well system of a specified configuration (including drilling depth and expected downhole temperatures) are to be modeled. Such modeling can be done using, for example, an Advanced Thermodynamics Temperature Simulator. At step 604, a suitable well circulation system including a CHE system using liquid nitrogen for fluid cooling is designed based on the modeling, including cooling capacity, valving, storage tanks, flow rates, volumes and other components and parameters. The CHE system can be CHE system 164 as described above (including but not limited to any of embodiments 164*a*, 164*b*, or 164*c*), including a drilling fluid conduit and an outer jacket. An inner surface of the outer jacket can least partially defines an interior volume within which the drilling fluid conduit is at least partially disposed.

At step 606, the circulation and CHE systems are assembled and connected to the well system, with the CHE system positioned, for example, at a surface location separate from a wellhead of the wellbore, and the interior volume is at least partially defined by an inner surface of an outer jacket of the CHE system, as described above. At step 608, an interior volume of a CHE system is filled with liquid nitrogen.

Proceeding to step 610, drilling fluid is circulated in the wellbore (for example, in a downhole direction down a drill string and thence uphole through the wellbore annulus to the surface). In some embodiments, the liquid nitrogen filling step 608 occurs after the drilling fluid flow is initiated in the wellbore, or another suitable time. At step 612, drilling fluid is flowed from the wellbore to a drilling fluid conduit of the CHE system at least partially disposed within the interior volume. At step 614, the drilling fluid flowing through the drilling fluid conduit is cooled by heat exchange with the liquid nitrogen across a wall of the drilling fluid conduit.

At step 616, in some embodiments, the operator can determine (based on temperature measurements or other data or information) whether repeated cooling of the drilling fluid is desired or necessary, prior to returning the drilling fluid to the wellbore. If at step 616 it is determined that such repeated cooling is necessary or desirable, the method proceeds to step 618 in which at least a portion of the drilling fluid is diverted (for example, by a diverter that is a component of or fluidically connected to the insulated circulating tank) to an intermediate recirculating pump. Proceeding to step 620, the diverted portion is again cooled in the CHE system. After step 620, the method then proceeds back to step 616 in which the operator again can determine (based on temperature measurements or other data or information) whether repeated cooling of the drilling fluid is desired or necessary.

If at step 616 it is determined that no further cooling of the drilling fluid is desirable or necessary, the method then proceeds to step 622 in which the portion is flowed back to the wellbore (for example, via a mud pump). After step 622, the method returns to step 610 in which the drilling fluid continues to be circulated in the wellbore.

In some embodiments, the method may not include a repeated-cooling step and, in such embodiments, steps 616, 618, and 620 are omitted and, after step 614, the method proceeds to step 622 in which all of the drilling fluid flowed through the drilling fluid conduit is flowed by a mud pump back to the wellbore.

The term "uphole" as used herein means in the direction along a drill string, tubing, or the wellbore from its distal end towards the surface, and "downhole" as used herein means the direction along the drill string, tubing, or the wellbore from the surface towards its distal end. A downhole location means a location along the drill string, tubing, or wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A system for cooling drilling fluid circulating in a wellbore drilled by wellbore drilling system, the system comprising:

a drilling fluid conduit positioned at a surface location separate from a wellhead of the wellbore, through which passes drilling fluid flowed from the wellbore; and an outer jacket, an inner surface of which at least partially defines an interior volume within which the drilling fluid conduit is at least partially disposed, wherein the interior volume is at least partially filled with liquid nitrogen, such that the drilling fluid passing through the drilling fluid conduit is cooled by heat exchange with the liquid nitrogen across a wall of the drilling fluid conduit prior to flowing back into the wellbore via a mud pump.

2. The system of claim 1, further comprising a coolant injection system configured to selectively inject liquid nitrogen into the coolant volume.

3. The system of claim 1, wherein the drilling fluid flowed from the wellbore passes through a shale shaker prior to passing through the drilling fluid conduit.

4. The system of claim 1, wherein the drilling fluid flows from the drilling fluid conduit to a mud pump, the mud pump configured to pump the drilling fluid back into the wellbore.

5. The system of claim 1, wherein at least a portion of the drilling fluid flows from the drilling fluid conduit to an insulated circulating tank and thence from the insulated circulating tank back to the drilling fluid conduit, prior to flowing from the drilling fluid conduit to the mud pump.

6. The system of claim 1, wherein the drilling fluid conduit and the outer jacket are coaxial tubulars.

7. The system of claim 1, wherein the interior volume is at least partially defined by an outer surface of the drilling fluid conduit.

8. The system of claim 1, wherein the drilling fluid conduit is concentric with the outer jacket.

9. The system of claim 1, wherein the drilling fluid conduit is a first drilling fluid conduit of a plurality of drilling fluid conduits disposed within the outer jacket.

10. The system of claim 1, wherein the liquid nitrogen is in direct contact with an outer surface of the drilling fluid conduit.

11. The system of claim 1, wherein the liquid nitrogen is not in direct contact with an outer surface of the drilling fluid conduit.

12. The system of claim 1, further comprising an intermediate tubular coaxial with and disposed within the outer jacket and within which the drilling fluid conduit is disposed, and wherein an annular volume defined by an inner surface of the intermediate tubular and an outer surface of the drilling fluid conduit is at least partially filled with water, and wherein cooling the drilling fluid flowing through the drilling fluid conduit by heat exchange with the liquid nitrogen across the wall of the drilling fluid conduit comprises:

cooling the water filling the annular volume at least partially by heat exchange with the liquid nitrogen; and cooling the drilling fluid at least partially by heat exchange with the water filling the annular volume.

13. The system of claim 1, further comprising a plurality of fins extending radially from an outer surface of the drilling fluid conduit.

14. An apparatus for cooling a drilling fluid circulating in a wellbore drilling system configured to drill a wellbore, the apparatus comprising:

a main body;

a drilling fluid conduit disposed within the main body; and an outer jacket, an inner surface of which at least partially defines an interior volume within which the drilling fluid conduit is at least partially disposed, wherein the interior volume is configured to be at least partially filled with liquid nitrogen;

wherein the apparatus is positioned at a surface location separate from a wellhead of the wellbore and configured so as to receive a volume of drilling fluid flowed from the wellbore, and wherein the volume of drilling fluid can pass through the drilling fluid conduit and the drilling fluid is cooled by heat exchange with the liquid nitrogen across a wall of the drilling fluid conduit prior to flowing back into the wellbore via a mud pump.

15. The apparatus of claim 14, wherein the wellbore drilling system is a wellbore drilling system for drilling a wellbore at a first wellsite, and the apparatus is an assembly configured to be transported as a unit from the wellbore drilling system at the first wellsite to a wellbore drilling system at a second wellsite.

16. The apparatus of claim 14, wherein the apparatus is configured such that liquid nitrogen from a coolant injection system can fill the coolant volume, and wherein the coolant injection system is a component of the apparatus.

17. The apparatus of claim 14, wherein the liquid nitrogen is in direct contact with an outer surface of the drilling fluid conduit.

18. The apparatus claim 14, further comprising an intermediate tubular coaxial with and disposed within the outer jacket and within which the drilling fluid conduit is disposed, and wherein an annular volume defined by an inner surface of the intermediate tubular and an outer surface of the drilling fluid conduit is at least partially filled with water, and wherein cooling the drilling fluid flowing through the drilling fluid conduit by heat exchange with the liquid nitrogen across the wall of the drilling fluid conduit comprises:

cooling the water filling the annular volume at least partially by heat exchange with the liquid nitrogen; and cooling the drilling fluid at least partially by heat exchange with the water filling the annular volume.

19. A method of cooling a drilling fluid circulating in a wellbore drilled by a wellbore drilling system, the method comprising:

filling, with liquid nitrogen, an interior volume of a cryogenic heat exchange system positioned at a surface location separate from a wellhead of the wellbore, the interior volume at least partially defined by an inner surface of an outer jacket of the cryogenic heat exchange system;

flowing, through a drilling fluid conduit of the cryogenic heat exchange system at least partially disposed in the interior volume, a drilling fluid flowed from the wellbore;

cooling, by heat exchange with the liquid nitrogen across a wall of the drilling fluid conduit, the drilling fluid flowing through the drilling fluid conduit;

flowing, via a mud pump, the drilling fluid back into the wellbore.

20. The method of claim 19, further comprising:

flowing the drilling fluid from the drilling fluid conduit to an insulated circulating tank;

flowing at least a portion of the drilling fluid from the insulating circulating tank back to the drilling fluid conduit;

cooling, by heat exchange with the liquid nitrogen across the wall of the drilling fluid conduit, the portion;

flowing, by the mud pump, the portion from the drilling fluid conduit to the wellbore, wherein the flowing, via the mud pump, the drilling fluid back into the wellbore comprises flowing the portion into the wellbore.

* * * * *